US005097631A

United States Patent [19]

Ford

[11] Patent Number: 5,097,631

[45] Date of Patent: Mar. 24, 1992

[54] CIRCULAR EDGER ATTACHMENT FOR VERTICAL GLASS EDGER

[75] Inventor: Ronald N. Ford, Lemont, Ill.

[73] Assignee: Sommer & Maca, Chicago, Ill.

[21] Appl. No.: 598,433

[22] Filed: Oct. 16, 1990

[51] Int. Cl.[5] ..... B23C 3/05

[52] U.S. Cl. ..... 51/105 R; 51/105 EC; 51/106 R; 51/241 R

[58] Field of Search ..... 51/241 R, 241 G, 283 R, 51/283 E, 102, 105 R, 105 EC, 103 R, 104, 106 R

[56] References Cited

U.S. PATENT DOCUMENTS 3,899,917 8/1975 Kisbany ..... 51/106 R
4,528,780 7/1985 Halberschmidt ..... 51/105 EC
4,672,776 6/1987 McCullough ..... 51/105 R
4,908,992 3/1990 Cevrero et al. ..... 51/283 E

*Primary Examiner*—Bruce M. Kisliuk
*Assistant Examiner*—Eileen Morgan
*Attorney, Agent, or Firm*—Fleit, Jacobson, Cohn, Price, Holman & Stern

[57] ABSTRACT

A vertical glass edger is modified to edge a circular piece of glass by driving the circular piece of glass in contact with a grinding wheel of the vertical glass edger. The vertical glass edger is modified to include a removable pressure roller assembly, drive roller assembly and an idler roller assembly which are used to bias circular glass toward the grinding wheel in a stabilized manner. The attachment provides flexibility in edging circular glass of a diameter of 16 to 72 inches.

15 Claims, 3 Drawing Sheets

CIRCULAR EDGER ATTACHMENT FOR VERTICAL GLASS EDGER

FIELD OF THE INVENTION

This invention relates to the adaptation of a vertical glass edger to edge circular glass.

BACKGROUND OF THE INVENTION

Traditionally, square or rectangular plate glass is provided with a pencil edge, flat and seam edge, miter edge or O. G. edge by a vertical glass edger. Circular plate glass is edged by use of a horizontal beveler edger. These two separate machines are required to provide full service edging for different shapes of glass.

An example of a vertical glass edger is a VE-4 vertical glass edger available from Sommer and Maca Industries, Inc. of Chicago, Ill. This vertical glass edger, as shown in FIG. 1, is designed to grind and polish edges on the most common range of glass thicknesses of rectangular and square shapes of glass while the glass is held vertically. The edger includes three main assemblies: the center section, conveyor section, and glass support frame.

The center section includes a control panel, grinding and polishing wheels and drive motors, conveyor drive motor and gears, coolant pump and filtration system, front pad conveyor chain, and rear register pad conveyor chain. The edger uses two diamond grinding wheels seven inches in diameter and two polishing wheels eight inches in diameter.

The conveyor system includes an infeed belt that carries glass into the center section, where it is gripped by the chain pads and moved through the edger by means of conveyor chains. The glass moves out of the chain pad's grip onto the outfeed belt. The conveyor can be varied in speed from 0 to 240 inches per minute.

The glass support frame supports glass vertically as it is conveyed through the grinding and polishing operation. The frame can accommodate glass as short as four inches and as long as 72 inches, to a maximum height of 72 inches, and any thickness from ⅛ inch through ¾ inch. Two end uprights support both the frame and the ends of the conveyor system.

For edging of round plate glass, a shape beveler edger such as a Somaca SBE-1 beveler, edger and polisher available from Sommer & Maca Industries, Inc., of Chicago, Ill., may be used. This machine efficiently bevels, edges and polishes custom shapes, circles and ovals. The machine edges 20½ inch to 100 inch diameter glass. A piece of glass to be beveled, edged or polished is horizontally mounted on top of a plurality of support cups. The support table is rotated about a vertical axis for beveling, edging and polishing the vertically extending edge of a piece of glass.

SUMMARY OF THE INVENTION

It is an object of the present invention to provide aN attachment to a machine used for the edging of rectangular or square pieces of glass so that the machine can edge circular pieces of glass.

This object is obtained by modifying a vertical glass edger so that a circular piece of glass is edged by driving the circular piece of glass in contact with one or two of the grinding wheels of the vertical glass edger. The vertical glass edger is modified to include a removable attachment which is used to bias circular glass toward the grinding wheel. The attachment provides flexibility in edging circular glass of a diameter of 16 to 72 inches.

An adjustable height pressure roller is removably and slidably secured to a support post of a support frame of the vertical glass edger so as to be vertically adjustable to accommodate different diameter glass. The pressure roller is located adjacent to the highest point on a central vertical axis of the glass with a vertical axis of the pressure roller being offset slightly from the vertical axis of the glass.

A drive roller is removably and slidably secured to the vertical glass edger and contacts the edge of the glass with a horizontal axis of the drive roller being located below a central horizontal axis of the glass.

An idler roller is removably and slidably secured to the vertical glass edger and is positioned to engage the edge of the glass on an opposite side of the central vertical axis of the glass from the drive roller, also at a point located below the central horizontal axis of the glass.

Both the drive roller and its accompanying power drive system and the idler roller, as well as the pressure roller, are slidably mounted on the vertical glass edger to accommodate different diameter glass.

It is therefore another object of the present invention to include an attachment to a vertical glass edger to edge circular glass.

It is yet another object of the present invention to include an attachment to a vertical glass edger to edge circular glass and with the attachment being adjustable to accommodate different diameter glass.

It is still yet another object of the present invention to include an attachment to a vertical glass edger to edge circular glass with the attachment being adjustable to accommodate different diameter glass and with the attachment being removable from the vertical glass edger for resumption of straight edge glass edging.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 1:
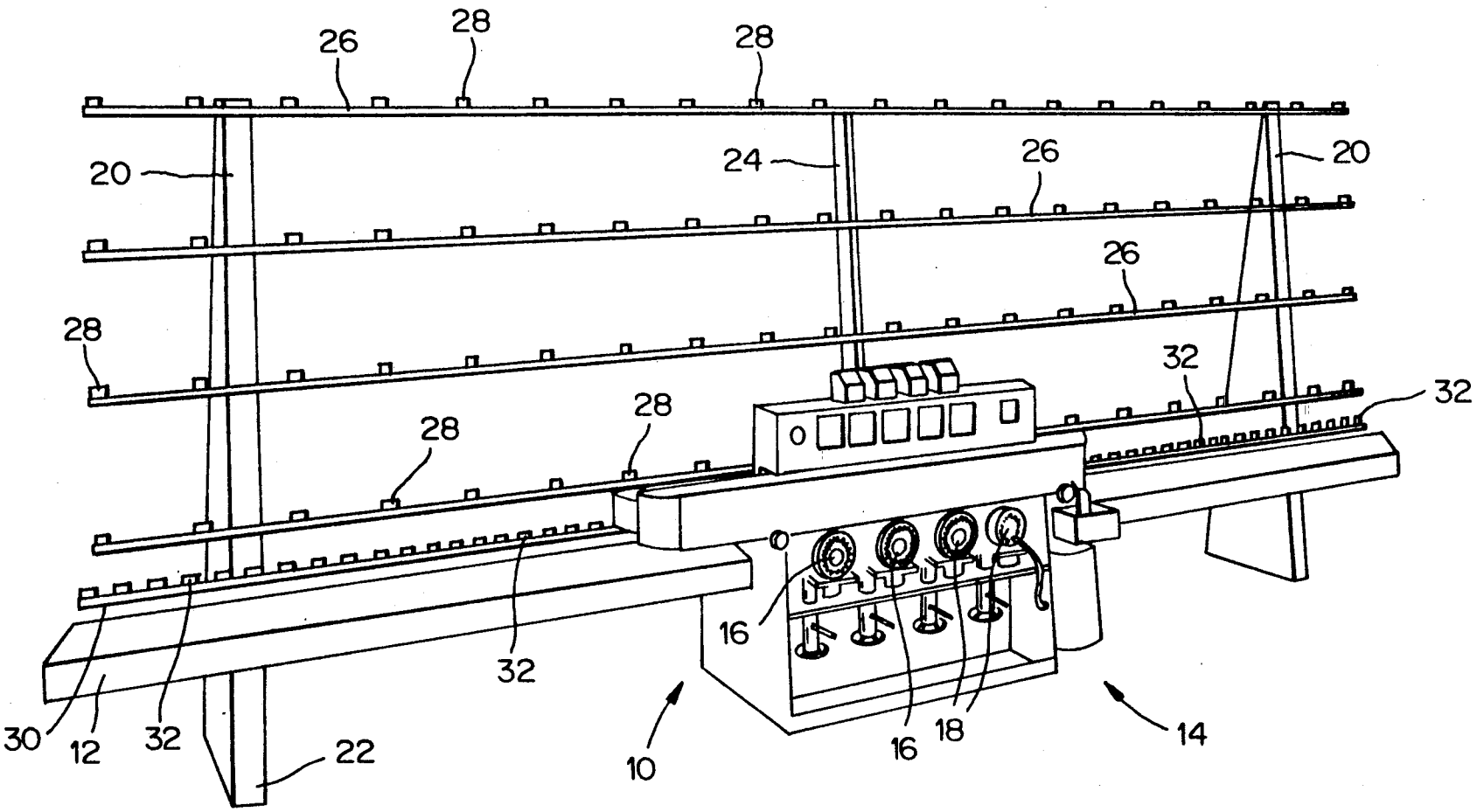
FIG. 1 (PRIOR ART)
FIG. 1 illustrates a known vertical edger.

In FIG. 1, a vertical glass edger 10 is shown. A conveyor support system 12 provides for the horizontal transfer of glass across a central section 14, which includes two downstream grinding wheels each having a drive motor 16 and two upstream polishing wheels each having a drive motors 18. Positioned on opposite sides of the central section 14 are end support racks 20 having leveling screws 22 located between the support racks 20 and at their base. A rail support rack 24 is centrally located between the support racks 20 and opposite the central section 14.

A plurality of horizontally extending roller mounting rails 26 include a plurality of spaced rollers 28 for guiding a vertically extending piece of glass as it is conveyed along the conveyor section 12 for edging of a straight edge. A lowermost horizontally extending rail 30 includes a plurality of closely spaced rollers 32 each having a vertical rotation axis.

Figure 2:
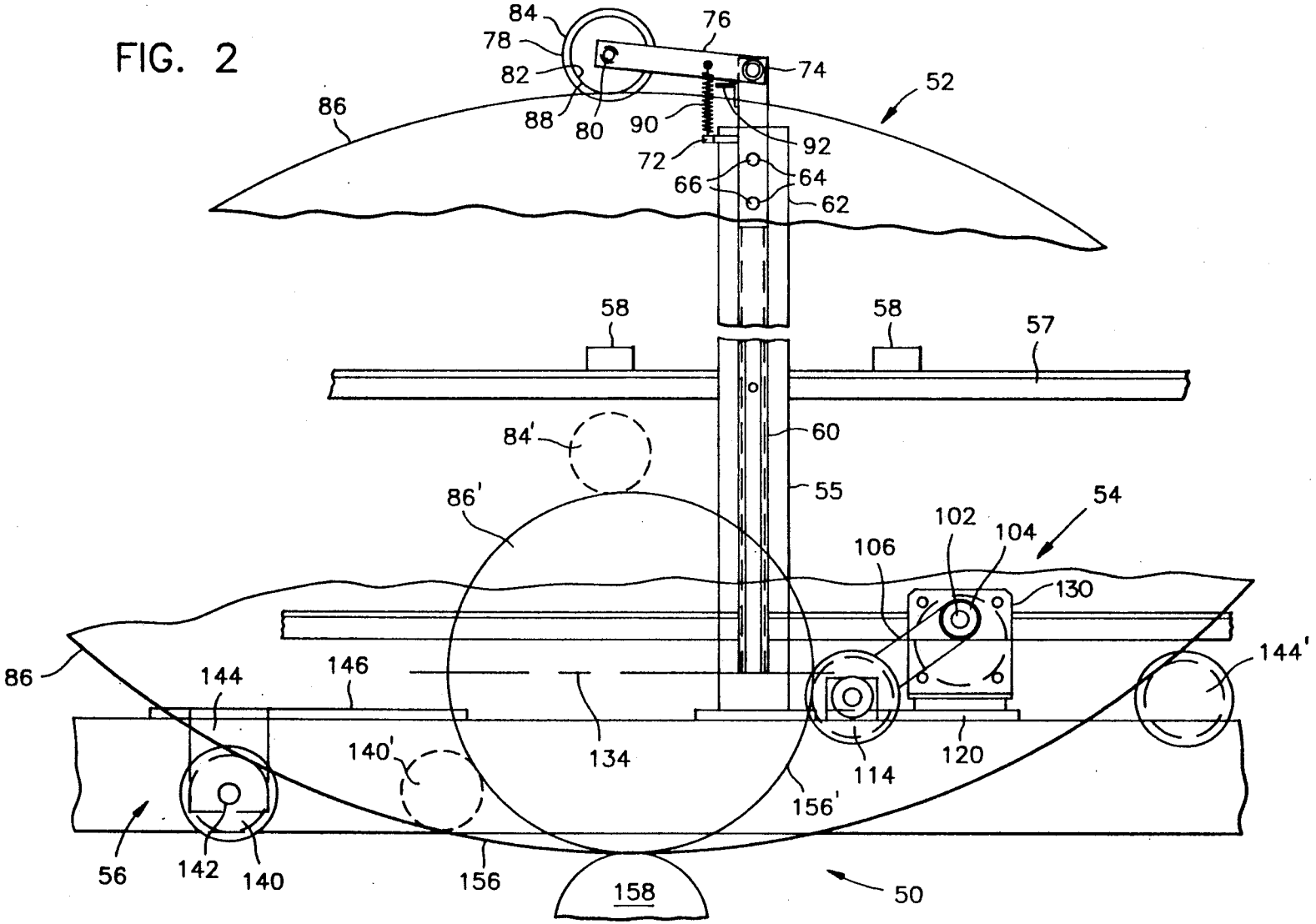
FIG. 2 illustrates a circular edger attachment mounted on a vertical glass edger.
Figure 3:
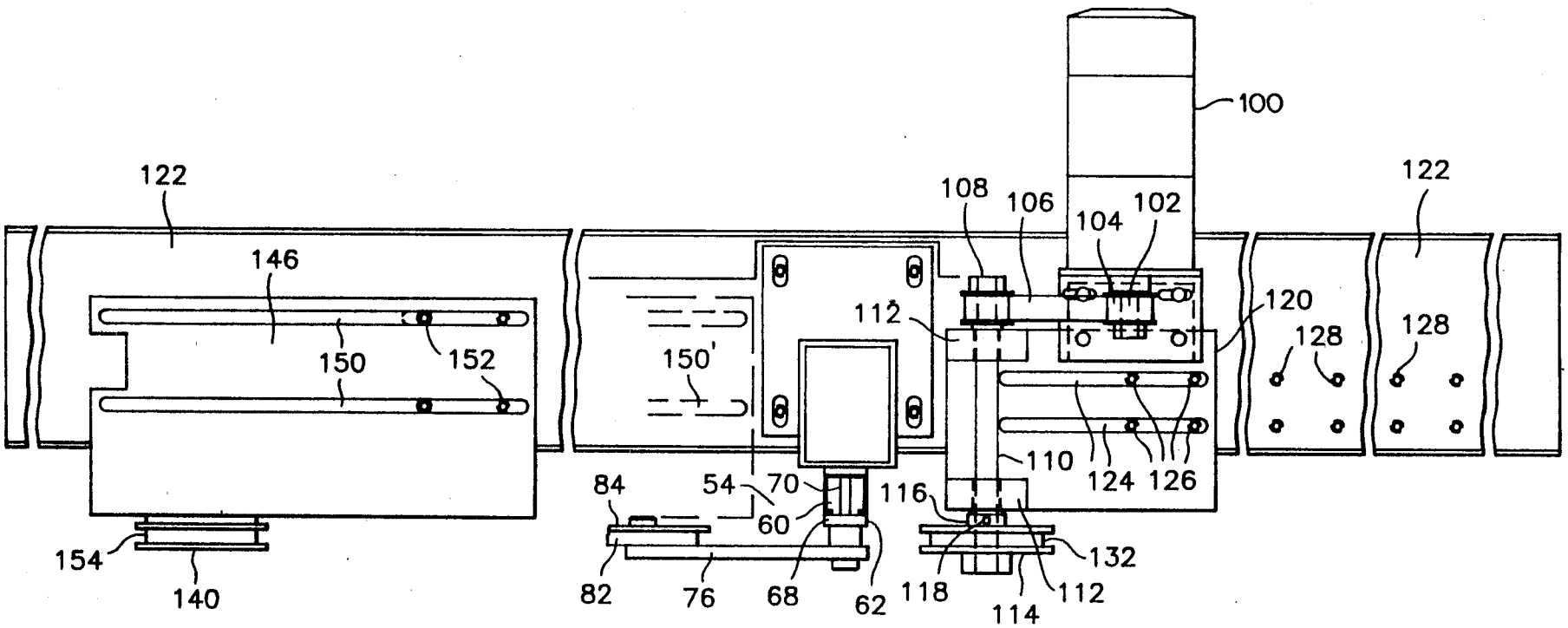
FIG. 3 is a top plan view of the circular edger attachment shown in FIG. 2.

In describing a preferred embodiment of the invention as illustrated in FIGS. 2 and 3, specific terminology will be resorted to for the sake of clarity. However, the invention is not intended to be limited to the specific terms so selected, and it is to be understood that each specific term includes all technical equivalents which operate in a similar manner to accomplish a similar purpose.

With reference to FIG. 2, a circular edger attachment 50 is shown. The circular edger attachment includes a pressure roller assembly 52, a drive roller assembly 54 and an idler roller assembly 56.

In the pressure roller assembly 52, a vertically extending support post 55 which corresponds to the rail support rack 24 of the vertical edger shown in FIG. 1, extends transverse to horizontally extending roller mounting rails 57 having spaced rollers 58. A pressure roller adjusting channel 60 extends vertically along the length of the support post 54.

Slidably mounted within the pressure roller adjusting channel is pressure roller mounting bracket 62 having two holes 64 for receipt of mounting screws 66. The mounting screws are used in locking the mounting bracket after the pressure roller is moved longitudinally along the roller rail support 54.

As shown in FIG. 3, a portion 68 of the pressure roller mounting bracket 62 is located within the channel 60 for slidably moving the mounting bracket within the adjusting channel. The shank 70 of uppermost set screw 66 is shown extending into the adjusting channel so as to abut against a rear wall of the adjusting channel to fix a desired positioning of the mounting bracket 54 along the length of the channel 60.

Extending laterally from one side of the mounting bracket 62 is a spring pin 72, as shown in FIG. 2. Spaced above the spring pin 72 and also extending laterally from the mounting bracket 62, about a pivot connection 74, is pressure roller arm 76. At an opposite end of the pressure roller arm, from the end connected to the mounting bracket, is located pressure roller 78 rotatably mounted on the pressure roller arm by shoulder screw 80.

The pressure roller 78 includes a recessed portion 82 having a diameter less than a projecting portion 84. A piece of round glass 86 (shown having two separated arcs for purposes of illustration) having a 72 inch diameter, abuts against recessed portion 82 as shown in FIG. 2. The projecting portion 84 extending beyond the periphery of the glass 86 so that a portion of the glass rests against a vertically extending side wall 88 located between recessed portion 82 and projecting portion 84 so as to support the piece of glass 86 with side wall 88 contacting the glass. A spring 90 extends between the pressure roller arm and the spring screw 72 so as to bias the pressure roller 78 downwardly against the glass 86. A pressure roller armrest 92 acts as a stop to limit the downward movement of the pressure roller arm 76.

By unscrewing set screw 66 and sliding of the pressure roller mounting bracket 62 within channel 60 of support post 54, the pressure roller assembly 52 may be lowered such as is shown by pressure roller 84' for contacting a piece of circular glass 86' having as small as a 16 inch diameter. Accordingly, circular glass having a diameter from 16 through 72 inches may be edged by the circular edge attachment shown in FIGS. 2 and 3.

By unscrewing set screws 66 and sliding mounting bracket 62 vertically, up out of the channel 60, the pressure roller may be removed from the vertical edger. The vertical edger may then resume its original edging capability of edging horizontally extending edges. The vertical edger may be quickly modified for edging circular glass by again inserting the mounting bracket 62 in the channel 60.

The drive roller assembly 54 includes a drive gear motor. 100 having a motor shaft 102 onto which is mounted a drive pulley 104. Extending about the pulley 104 is a timing drive belt 106 which also surrounds a timing belt pulley 108. The timing belt pulley is mounted on one end of a drive shaft 110. Drive shaft 110 is mounted in bearings 112. At an opposite end of the drive shaft from the pulley 108 is located a drive roller 114 with a collar 116 having a collar set screw 118 for removably mounting the drive roller on the drive shaft. The drive shaft as well as the drive roller are removable from the drive roller assembly 54 for return of the vertical edger for edging of horizontally extending edges of plate glass. The center axis of the drive roller 114 is positioned to be located below a horizontal central axis 134 of circular glass 86 or 86'.

The drive roller assembly is mounted on a drive mounting bracket 120 which is slidably mounted on a horizontally extending support platform 122 formed from a tubular structure of a center section of a straight line edger. The bracket 120 includes two longitudinally slots 124 through which set screws 126 extend for positioning the bracket 120 along the platform 122 by securing the set screws 126 within the holes 128 spaced along the platform 122. An L-shaped motor bracket 130 is secured to the motor 100 and to the bracket 120 for torsion adjustment of the timing belt pulley 106.

As shown in FIG. 2, drive roller 114 is shown engaging a peripheral edge of circular glass 86'. When the drive roller assembly is slid to the right and locked in position by set screws 126, drive roll 114' will be located as shown, engaging large diameter circular glass 86.

The drive roller 114 includes a groove 132 within which circular glass is positioned for engagement with the drive roller 114. The circular glass is thereby rotated upon rotation of the drive roller 114. Different size drive rollers having different width grooves 132 may be used to accommodate various thicknesses of circular glass. Typically, as a preferred example, circular glass ¼ inch to ½ inch thick may be ground.

The idler roller assembly 56 includes an idler roller 140 mounted on a roller shaft 142. The shaft 142 is mounted on a vertically extending plate 144 which extends from idler roller support bracket 146. The idler roller support bracket 146 is slidably mounted on the support platform 122, as shown in FIG. 3. Two longitudinally extending slots 150 of bracket 146 have set screws 152 extending through the slots to engage platform 122. The set screws lock the position of the bracket 146 and thereby the position of the idler roller at various locations according to the diameter of the circular glass to be ground. Roller 140' illustrates a position of the idler roller to accommodate small diameter glass.

The bracket 146 is removably mounted on platform 122 by unscrewing of set screws 152 to facilitate return of the vertical edger to the edging of horizontally extending edges of plate glass. The idler roller has a groove 154 for receiving the peripheral edge of the circular glass. Similar to the drive roller, idler rollers are available with various widths for groove 154, within which the glass is held so as to stabilize the rotation of the piece of circular glass.

By the present invention, circular glass is rotated in a vertical orientation and supported at three points so that the peripheral edge 156 of circular glass 86 or peripheral edge 156' of circular glass 86' contacts grinding wheel 158. Grinding wheel 158 is the same grinding wheel used for edging of horizontally extending edges before the edger is modified for edging circular glass.

The positioning of the pressure roller assembly 52, driver roller assembly 54 and idler roller assembly 56 are all adjustable to accommodate different diameter circular glass. Further, the driver roller 114 and idler roller 140 are changeable for accommodating various thicknesses of circular glass preferably ranging from ¼ quarter inch to ½ inch in thickness. In addition, the pressure roller assembly, drive roller assembly and idler roller assembly are removably mounted on a vertical glass edger so that the vertical glass edger may be used for edging of horizontally extending edges or modified for edging glass.

Having described the invention, many modifications thereto will become apparent to those skilled in the art to which it pertains without deviation from the spirit of the invention as defined by the scope of the appended claims.

I claim:

1. A circular edger attachment for a vertical glass edger, said circular edger attachment comprising:

orientation means for orienting a circular piece of glass in a vertical direction, said orientation means including a pressure roller assembly for resiliently biasing the circular piece of glass into contact with a grinding wheel of the vertical glass edger, and drive means for rotatably driving the vertically oriented circular piece of glass on a vertical support frame of the vertical glass edger so as to grind the entire periphery of an edge of the circular piece of glass on the vertical glass edger.

2. A circular edger attachment as claimed in claim 1, wherein said orientation means and said drive means are removably mounted on the vertical glass edger.

3. A circular edger attachment as claimed in claim 2, wherein said orientation means also includes an idler roller assembly.

4. A circular edger attachment as claimed in claim 3, wherein said pressure roller assembly is slidably mounted on the vertical glass edger for movement in a vertical direction.

5. A circular edger attachment as claimed in claim 3, wherein said drive means is slidably mounted on the vertical glass edger for movement in a horizontal direction.

6. A circular edger attachment as claimed in claim 3, wherein said idler roller assembly is slidably mounted on the vertical glass edger for movement in a horizontal direction.

7. A circular edger attachment as claimed in claim 1, wherein said orientation means includes a pressure roller assembly for biasing the circular piece of glass downwardly against an edger of the vertical glass edger.

8. A glass edger comprising:

a vertical support frame, edging means for edging the entire periphery of an edge of glass, said edging means being mounted adjacent to said vertical support frame, and edge engaging means removably mounted on said support frame for rotatably driving a piece of circular glass in a vertical orientation and in contact with said edging means so as to edge a lowermost surface of the circular glass.

9. A glass edger as claimed in claim 8, wherein said edge engaging means includes a pressure roller assembly, a drive roller assembly, and an idler roller assembly.

10. A glass edger as claimed in claim 8, wherein said support frame includes a vertically extending support post and said pressure roller assembly is slidably mounted on said support post to accommodate various diameters of circular glass to be edged.

11. A glass edger as claimed in claim 10, wherein said pressure roller assembly includes a pressure roller biased downwardly to engage a peripheral edge of the circular glass.

12. A glass edger as claimed in claim 9, wherein said drive roller assembly is slidably mounted on said vertical support frame.

13. A glass edger as claimed in claim 9, wherein said idler roller assembly is slidably mounted on said vertical support frame.

14. A vertical glass edger comprising:

a vertical support for supporting a piece of circular glass in a vertical direction, at least one edging wheel for edging a lowermost surface of the piece of circular glass, an edge wheel drive motor for rotating said at least one edging wheel.

orientation means for guiding the circular piece of glass during rotation and for biasing the circular piece of glass downward against said at least one edging wheel, and drive means for rotating the circular piece of glass while in contact with said at least one edging wheel and said orientation means during rotation of said at least one edging wheel for edging of the lowermost surface of the piece of circular glass.

15. A circular edger attachment for a vertical glass edger, said circular edger attachment comprising:

means for guiding a circular piece of glass during rotation in a vertical plane and for biasing the circular piece of glass against at least one edging wheel of a vertical glass edger for edging the entire periphery of a lowermost surface of the circular piece of glass, and drive means for rotating the circular piece of glass while in contact with the at least one edging wheel during rotation of the at least one edging wheel.

* * * * *